US011420462B2

(12) United States Patent
Rasmussen et al.

(10) Patent No.: US 11,420,462 B2
(45) Date of Patent: Aug. 23, 2022

(54) TRANSFER PAPER

(71) Applicants: vph GmbH & Co. KG, Hemmingen (DE); Knud Villefrance Rasmussen, Silkeborg (DK)

(72) Inventors: Knud Villefrance Rasmussen, Silkeborg (DK); Stephan Krauss, Nuremberg (DE)

(73) Assignee: VPH GMBH & CO. KG, Hemmingen (DK)

( * ) Notice: Subject to any disclaimer, the term of this patent is extended or adjusted under 35 U.S.C. 154(b) by 0 days.

(21) Appl. No.: 17/144,703

(22) Filed: Jan. 8, 2021

(65) Prior Publication Data

US 2021/0221159 A1 Jul. 22, 2021

(30) Foreign Application Priority Data

Jan. 17, 2020 (EP) ..... 20152418

(51) Int. Cl.

| | |
|---|---|
| ***B41M 5/50*** | (2006.01) |
| ***B41M 5/52*** | (2006.01) |
| ***B41M 5/035*** | (2006.01) |
| ***D06P 5/28*** | (2006.01) |

(52) U.S. Cl.
CPC ..... *B41M 5/5236* (2013.01); *B41M 5/035* (2013.01); *B41M 5/502* (2013.01); *D06P 5/004* (2013.01)

(58) Field of Classification Search
CPC .... B41M 5/5236; B41M 5/035; B41M 5/502; D06P 5/004
USPC ..... 428/32.12
See application file for complete search history.

(56) References Cited

U.S. PATENT DOCUMENTS

| | | | | |
|---|---|---|---|---|
| 6,805,046 | B1 * | 10/2004 | Rasmussen | B41M 5/52 101/33 |
| 2017/0305178 | A1 | 10/2017 | Kuhne | |
| 2021/0221159 | A1 * | 7/2021 | Rasmussen | D21H 19/34 |

FOREIGN PATENT DOCUMENTS

| | | | |
|---|---|---|---|
| WO | 0006392 | A1 | 2/2000 |

* cited by examiner

*Primary Examiner* — Betelhem Shewareged
(74) *Attorney, Agent, or Firm* — Cantor Colburn LLP

(57) ABSTRACT

A transfer paper for heat transferring of ink to a textile, the transfer paper includes a base paper and a coating, and has a grease proof characteristics at a kit level of at least 3, such as 3 to 8, and the transfer paper having a dimensional stability of less than 1% over a period of 10 seconds.

18 Claims, 3 Drawing Sheets

TRANSFER PAPER

CROSS REFERENCE TO RELATED APPLICATION

Figure 1:
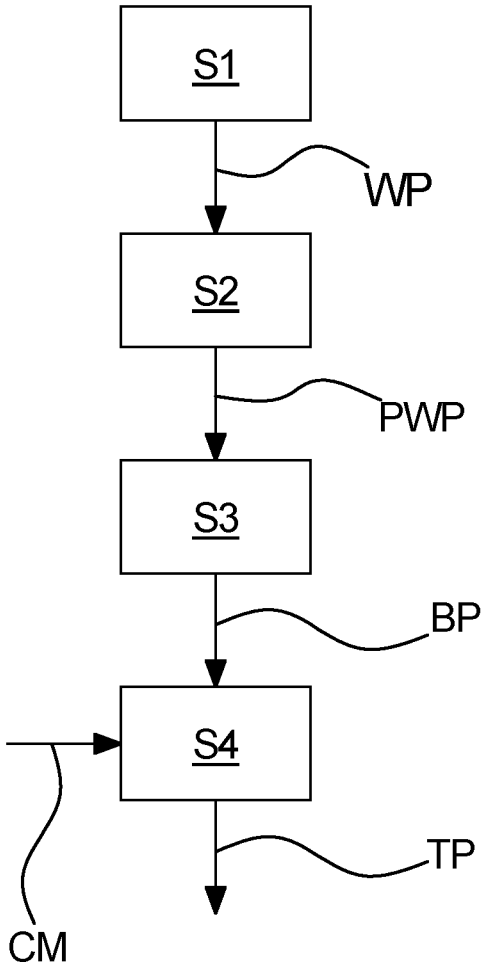

This application is related and claims the benefit of European Patent Application Number EP20152418.8 filed on 17 Jan. 2020, the entire contents of which are incorporated by reference herein.

FIELD OF INVENTION

The invention relates to a transfer paper according to the claims, particularly a transfer paper for heat transfer of ink to a textile. The invention further relates to a process for manufacturing a transfer paper, an inked transfer paper, and the use of an inked transfer paper for transferring ink to a textile, according to the claims.

BACKGROUND

A major challenge for transfer paper is cockling. Cockling occurs when the paper receives the water-based ink resulting in an out-of-plane deformation of the paper. Since dimensions are typically quite critical during the printing, such deformed sectors often come into contact with the printer head, leading to the ink being drawn into lines. These lines would, if such transfer paper is used to make inked textiles, be transferred to the textile, resulting in low quality products. Thus, entire rolls of transfer paper may need to be discarded when cockling occurs.

One way of suppressing cockling is the use of transfer papers having a relatively high thickness. The thickness somewhat minimizes cockling effects, however not completely. Moreover, this entails a higher use of pulp for making the paper, heavier paper rolls for a given length, and may also require more heating during the transfer phase, as the thicker paper forms an undesirable insulation barrier.

Some effort has been put into treating the transfer paper by various fluorochemicals to counteract the cockling. Such solutions are quite undesirable, as the fluoride-based chemicals used have or are suspected of having detrimental effects on the environment and/or human health.

As a result, printers have been developed with countermeasures. Several different solutions. For example, certain types of printer have a paper support with vacuum fixation of the paper to minimize cockling. However, such specialized printers suffer from the drawback that costs are relatively high and that cockling may still occur.

It is an object of the present invention to overcome the above disadvantages.

SUMMARY OF THE INVENTION

In the invention relates to a transfer paper for heat transferring of ink to a textile, the transfer paper comprising a base paper and a coating, characterized in that the transfer paper having grease proof characteristics at a kit level of at least 3, such as 3 to 8, and in that the transfer paper having a dimensional stability of less than 1% over a period of 10 seconds.

A major advantage of the invention may be that a cockle free paper provides for a very high print quality and thereby a very high quality of a subsequent textile to which the ink is transferred. Typically, cockling can be a major challenge, due to the transfer paper absorbing water and expanding relatively quickly after receiving the water-based ink. This leads to the so-called cockling of the paper, i.e. the expanding of the paper leads to deformation out of the original plane of the paper. This deformation may then lead to the inked transfer paper coming into contact with part e.g. of the printer on the inked side of the transfer paper, resulting in lines of ink. However, by use of the present invention, the cockling may surprisingly be avoided.

A further advantage of the invention may be that the paper does not have loose fibers or a rough surface on the non-print side. Thereby, it may be avoided that that printer parts do not become clogged, which could lead undesirable print quality.

A further advantage of the invention is that the high dimensional stability may be obtained for rather thin transfer papers, e.g. below 80 grams per square meter or even less, such as 40 grams per square meter or 30 grams per square meter. This provides both for a decreased use of raw materials for the production of the transfer paper, and for a decreased heating power during ink transfer.

Furthermore, the transfer paper of the present invention may be manufactured without the use of fluoride-containing chemicals, which are associated with significant environmentally and health related concerns.

Finally, the transfer paper of the present invention is usable for high quality ink transfer to textiles such as polyester, where conventional methods typically are expensive and/or inferior in quality.

In an embodiment of the invention, the dimensional stability is tested by accurately measuring the width of the paper before and after application of the ink. For example, before the application of ink and 10 seconds after application of the ink. Typically, paper expands uniformly in all three dimensions when wetting and thus the degree of expansion is a measure of the dimensional stability of the transfer paper.

As used herein the terms "cockle" and "cockling" refers to the undesirable out of plane deformation that may occur when water or water-based liquids, such as water-based ink, are contacted with transfer paper. Since cockling results from the transfer paper expanding as it absorbs water, cockling is related to dimensional stability. In other words, transfer papers having a high degree of dimensional stability are less prone to exhibit cockling and vice versa.

In the present context the term "greaseproof" refers to papers having a relatively closed surface, and which are therefore relatively impenetrable for substances such as grease (hence the term) and other substances. In an embodiment of the invention, the kit level is measured by the method published as TAPPI UM 557, which may also be referred to as the Kit-test. In an embodiment of the invention, greaseproof refers to papers having a kit level of at least 3, such as 3 to 8.

It is noted that the coating refers to a layer being deposited on a side of the paper. In some embodiments both sides of the base paper are coated, while in other embodiments only one side is coated. The coating material may in some embodiments penetrate the base paper itself to some extent, so as to partially impregnate the base paper. Nevertheless, the main portion of the coating material remains at the surface of the base paper as the coating. Also, the coating preferably forms a closed film.

It is noted that the terms "transfer paper" and "heat transfer paper" are used interchangeably to refer to transfer papers for transferring ink to textiles. Thus, it is essential for a transfer paper to be able to withstand the conditions used during the ink transfer step, hereunder particularly the high temperatures of about 200 degrees Celsius.

As used herein the term "dimensional stability" refers to the degree of expansion upon application of the water based ink. In an embodiment, the dimensional stability is established by measuring the width of the transfer paper before application of the ink and again at a specified time after application of the ink. When comparing the two measured widths, the degree of expansion, when given as a percentage of the original width, denotes the dimensional stability. As an illustrative example, if the dimensional stability is set to less than 1% after 30 seconds, the width before printing is compared to the width of a printed section measured 30 seconds after printing, and the widths are compared to see if the expansion exceeds 1% of the original width or not.

As used herein the term "ink" refers to a water-based ink, unless otherwise specified. Preferably the water-based ink contains disperse dyestuff.

In an embodiment of the invention, the coating comprises one or more selected from the list of carboxy methylcellulose (CMC), polyvinyl alcohol, starch, alginate, gelatin, and combinations thereof. Both unmodified starch and modified starch may be used.

In an advantageous embodiment of the invention, the coating comprises CMC.

An advantage of the above embodiment may be that an effective immobilization of the ink is provided. This is due to a relatively fast increase of the ink facilitated by the CMC containing coating. By immobilizing the ink, ink floating is avoided. In other words, quite well-defined features of ink can be made on the transfer paper, which is a prerequisite for a high-resolution print transfer.

The CMC may be provided in an aqueous solution, e.g. in concentration of at least 5% by weight, such as 5-40% by weight, such as 10-20% by weight. This concentration may be obtained by dissolving powdered CMC in suitable amounts of water.

In an advantageous embodiment of the invention, the coating before application comprises CMC in an amount of 5-30% by weight of the coating, such as in an amount of 5-20% by weight of the coating, such as in an amount of 10-15% by weight of the coating.

In other words, the "coating before application" refer to the applied coating material.

In an advantageous embodiment of the invention, the coating comprises CMC having a degree of substitution of at least 0.8, such as at least 0.9, such as at least 1.0.

By using a coating comprising CMC with a relatively high degree of substitution, liquid droplets of ink may be even further prevented from flowing and blurring, by facilitating an increase of the viscosity of the ink upon contact with the transfer paper.

In an advantageous embodiment of the invention, the coating comprises a saccharide, such as sorbitol.

An advantage of the above embodiment may be that anti smudging coating is facilitated, e.g. a relatively effective water absorption of the hygroscopic sorbitol and further by means of providing a tackiness at the high temperatures (e.g. 200 degree Celsius) during the transfer phase to counteract any movement of the textile relative to the transfer paper.

A further advantage of using sorbitol in combination with CMC may be that the advantages of both these substances may be utilized without drawbacks during processing of especially CMC, which may typically obtain an undesirable texture during processing. This is however synergistically counteracted by the presence of sorbitol.

In an embodiment of the invention, the coating comprises a saccharide, e.g. provided as a non-crystalline saccharide syrup, such as a sugar or sugar alcohol, e.g. provided as a sugar syrup or a sugar alcohol syrup.

In an embodiment of the invention, the coating comprises at least one selected from the list of sorbitol, mannitol, glucose, fructose, mannose, galactose, arabinose, xylose, ribose and combinations thereof.

As an example, the saccharide may be applied as a saccharide syrup in an amount of the order of approximately 30 g of dispersion per m2.

In an advantageous embodiment of the invention, the coating before application comprises sorbitol in an amount of 5-50% by weight of the coating, such as 5-30% by weight of the coating, such as 8-20% by weight of the coating, such as 10-14% by weight of the coating.

In other words, the "coating before application" refer to the applied coating material.

In an embodiment of the invention, the coating comprises CMC and saccharide, such as sorbitol, applied to the base paper in a single step.

In an embodiment of the invention, the transfer paper has a dimensional stability of less than 0.5% over a period of 10 seconds.

I.e. between 0 and 1%, such as between 0 and 0.5%.

In an embodiment, the transfer paper has a dimensional stability of less than 1% over a period of at least 20 seconds, such as at least 30 seconds.

In an embodiment, the transfer paper has a dimensional stability of less than between 0 and 1% over a period of at least 20 seconds, such as at least 30 seconds.

In an embodiment, the transfer paper has a dimensional stability of less than between 0 and 0.5% over a period of at least 20 seconds, such as at least 30 seconds.

In an advantageous embodiment of the invention, the transfer paper has a weight at most 80 grams per square meter, such as at most 70 grams per square meter, such as at most 60 grams per square meter, such as at most 50 grams per square meter, such as at most 40 grams per square meter, such as at most 30 grams per square meter.

In an embodiment of the invention, the transfer paper has a weight of 18 to 80 grams per square meter, such as 30 to 70 grams per square meter, such as 40 to 60 grams per square meter.

In an embodiment of the invention, the transfer paper has a weight of 18 to 80 grams per square meter, such as 20 to 60 grams per square meter, such as 20 to 50 grams per square meter, such as 20 to 40 grams per square meter.

In an advantageous embodiment of the invention, the transfer paper has an air permeance measured according to SCAN-P 26:78 below 65 nm/(Pa·s), such as below 30 nm/(Pa·s), such as below 10 nm/(Pa·s).

Herein, air permeance is given in nm/(Pa·s) which denoted nanometer per pascal second.

In an embodiment of the invention, the transfer paper has an air permeance measured according to SCAN-P 26:78 in the range of 0-65 nm/(Pa·s), such as in the range of 0-30 nm/(Pa·s), such as in the range of 0-10 nm/(Pa·s).

In an embodiment of the invention, the transfer paper is provided on rolls.

In an advantageous embodiment of the invention, the transfer paper is adapted to withstand temperatures of at least 200 degrees Celsius, such as at least 220 degrees Celsius.

In an advantageous embodiment of the invention, the base paper is made using an amount of pulp, wherein said pulp comprises beaten pulp in an amount of at least 35% by weight of said amount of pulp.

An advantage of the above embodiment may be that it facilitates obtaining a transfer paper having a desirable kit level of at least 3 and a dimensional stability of less than 1% over a period of 10 seconds.

In an embodiment of the invention, the base paper is made using an amount of pulp, wherein the pulp comprises beaten pulp in an amount of at least 45% by weight of the total amount of pulp.

In an embodiment of the invention, the base paper is made using an amount of pulp, wherein the pulp comprises beaten pulp in an amount of 35-65% by weight of the total amount of pulp, such as 45-65% by weight of the total amount of pulp.

In one embodiment of the present invention base paper 2 is based on either bleached or unbleached cellulose fibres or a mixture thereof.

In an advantageous embodiment of the invention, the transfer paper has a Cobb(60) value of 25 to 50 g/m$^2$, such as 30-45 g/m$^2$, such as 35-40 g/m$^2$.

Water absorption (Cobb) during 60 seconds was determined according to ISO 535. The Cobb value is defined as the amount of water in g/m$^2$ that is absorbed over the test area under a water pressure of 10 mm during a specified time. In the water absorbency tests the apparatus used was a Cobb Sizing Tester from Lorentzen & Wettre, Stockholm, Sweden. The Cobb60 value was determined in accordance with ISO 535. The results are reported as a value from a single measurement.

In an embodiment of the invention, the transfer paper has grease proof characteristics at a kit level of at least 4, such as at least 5, such as at least 6.

In an embodiment of the invention, the transfer paper has grease proof characteristics at a kit level of 4 to 8, such as 5 to 8, such as 6 to 7.

In an embodiment of the invention, the textile includes polyester textiles.

In an advantageous embodiment of the invention, the transfer paper comprises no more than 50 ppm of fluoride compounds, such as less than 20 ppm of fluoride compounds, such as less than 10 ppm of fluoride compounds, such as less than 10 ppm of fluoride compounds.

The above embodiment thus includes the absence of fluoride compounds, and also the absence of fluoride compounds added during manufacturing of the transfer paper.

In an embodiment of the invention the transfer paper is free of added fluoride compounds.

While small amounts of certain fluoride compounds may naturally be present in the wood pulp, no fluoride compounds are added according to the above embodiment.

The invention further relates to a process for manufacturing a transfer paper, the process comprising the steps of providing wood pulp, processing the wood pulp by beating and alkaline treatment, such as a sodium hydroxide treatment, to obtain a processed wood pulp, forming the processed wood pulp into a base paper, and applying a coating on the base paper to obtain a transfer paper.

In an embodiment of the invention, the transfer paper of the invention or any of its embodiments is obtainable by the process for manufacturing a transfer paper according to the invention or any of its embodiments.

In an embodiment of the invention the process does not include application of fluoride compounds.

In an embodiment of the invention, the transfer paper may comprise pigment, such as white pigment e.g. in the form of TiO2. The pigment may be provided by the base paper and/or the coating.

The invention further relates to an inked transfer paper for use for transferring ink to a textile, said inked transfer paper comprising a transfer paper according to the invention or any of its embodiments, and at least one ink applied on a surface of said transfer paper.

The invention further relates to the use of an inked transfer paper according to the invention or any of its embodiments for transferring ink to a textile.

In a further aspect of the invention, a method of manufacturing an inked textile comprises the following steps:

a) providing an inked transfer paper according to the invention or any of its embodiments;

b) providing a textile, such as a polyester based textile;

c) contacting said inked transfer paper and the textile obtained in step b);

d) optionally applying heat during step c).

In an embodiment of the invention, steps c) and d), if any, is performed by a calendar cylinder, e.g. comprising heating means when applying heating step d).

In an embodiment of the invention, the textile comprises polyester in an amount if at least 50% by weight of the textile, such as at least 60% by weight of polyester, such as at least 70% by weight of polyester, such as at least 80% by weight of polyester.

In an embodiment of the invention, the textile is a polyester based textile, such as a textile comprising at least 90% by weight of polyester, such as at least 95% by weight of polyester.

In an embodiment of the invention the process is carried out without any wastewater being produced during printing and transfer.

FIGURES

The invention will now be described with reference to the figures where

Figure 2A:
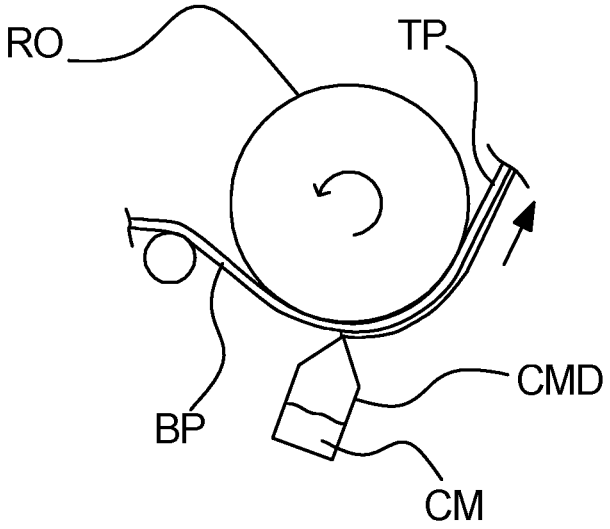
Figure 2B:
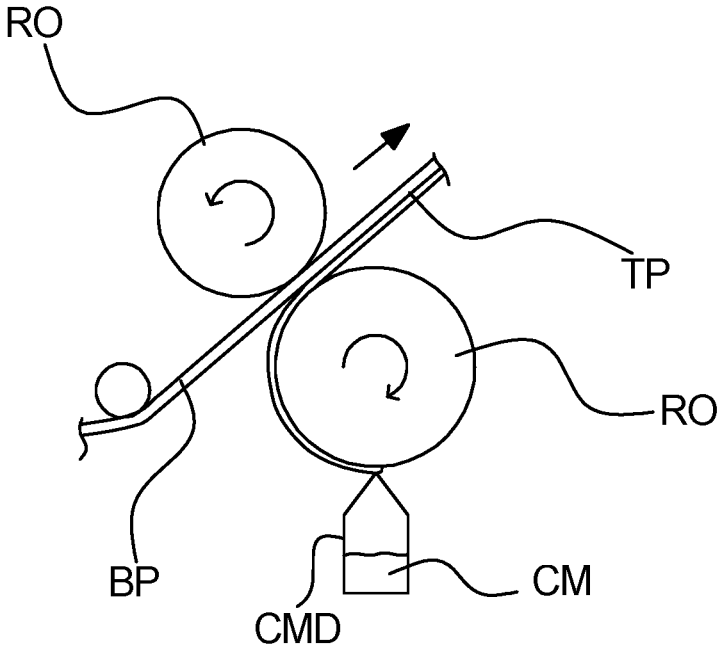
Figure 3:
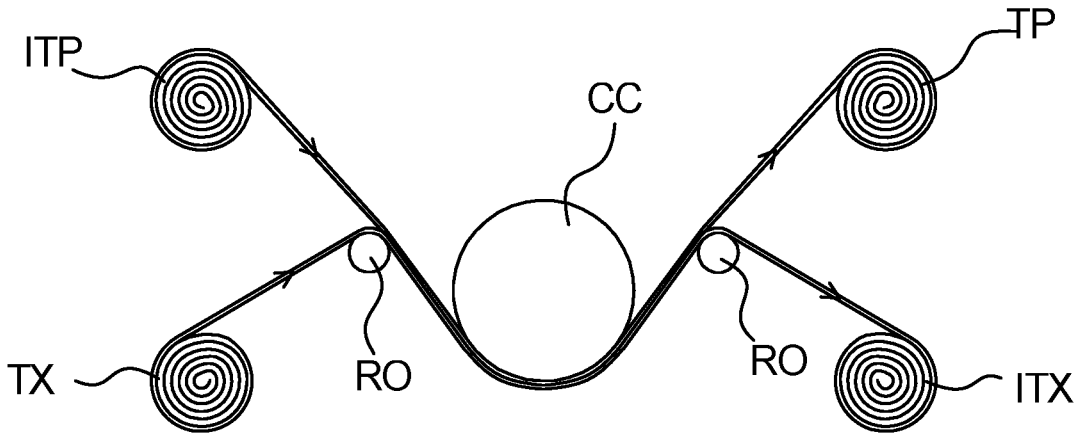

FIG. 1 illustrates a process for manufacturing a transfer paper according to an embodiment of the invention, FIGS. 2A-2B illustrate methods for applying the coating material according to embodiments of the invention, and FIG. 3 illustrates process of transferring ink from an inked transfer paper to a textile according to an embodiment of the invention.

DETAILED DESCRIPTION

Referring to FIG. 1, a process for manufacturing a transfer paper TP is illustrated in accordance with an embodiment of the invention.

In a first providing step S1, a wood pulp WP is provided. Various known wood pulps WP suitable for paper manufacturing may be used. In some alternative embodiments, pulp from non-wood sources may be used, e.g. rags or grasses.

The wood pulp WP is then processed in a processing step S2 by beating and alkaline treatment to obtain a processed wood pulp PWP. The alkaline treatment may e.g. comprise treatment with sodium hydroxide or alternatively potassium hydroxide or similar strong bases. The amount of base is increased when weaker bases is applied. This step is performed extensively beyond the level usually applied, to obtain a relatively effective breakdown of the wood pulp, both physically and chemically.

In embodiments of the invention, the beating continues until a relatively high degree of beaten cellulose pulp (also referred to a chemical cellulose pulp) is obtained, e.g. in the range of 35-65% by weight of the total amount of pulp. In the beaten cellulose pulp, the wood fibers are completely broken down primarily to cellulose, whereas the remaining pulp, the regular cellulose pulp, do comprise fibers.

In embodiments of the invention, smaller amounts of antifoaming agent may be added to the wood pulp before and/or during the beating. Alternatively, or in addition thereto, wetting agent (surfactant) may be added, e.g. to increase interaction between the alkaline water and the wood fibers, which may otherwise be water repellant e.g. due to presence of tree resin.

In embodiments of the invention, the beating may be carried out in various refiners, including commercially available refiners such as conical refiners and double disc refiners.

Returning to FIG. 1, the obtained processed wood pulp PWP is then formed into a base paper BP in a paper forming step S3. As a part of this step S3, the formed wood pulp is dried to obtain dry base paper BP. This drying may typically comprise e.g. irradiation with infrared radiation, and/or heating by means of heated rolls. Heated air may also be used for drying. This drying may remove both free water in pores and interstices between the fibers, and also water absorbed into the fibers themselves.

Typically, the processed pulp PWP obtained from the processing step S2 has a relatively high water content of about 98-99% by weight of the pulp. This water is gradually removed during the paper forming step S3.

In an embodiment of the invention, removal of water during and/or preceding the paper forming step S3 is carried out as follows. First, water is sieved off. Then, pulp is squeezed to remove a further amount of water, and finally, the remaining water is wiped off.

Returning to FIG. 1, in a coating step S4 a coating may be applied to the base paper BP. The coating is formed from a coating material CM, which may be applied step wise or in a single step. FIGS. 2A-2B illustrate various methods for applying the coating material CM. When the coating material CM has been deposited on the base paper BP, the final transfer paper TP is obtained.

By using the above illustrated method, a transfer paper TP for heat transferring of ink to a textile TX may be obtained. This transfer paper TP comprises a base paper BP and a coating, and having grease proof characteristics at a kit level of at least 3, such as 3 to 8, and further having a dimensional stability of less than 1% over a period of 10 seconds.

The coating material Cm used in step S4 may comprise one or more selected from the list of carboxy methylcellulose (CMC), polyvinyl alcohol, starch, alginate, gelatin, saccharides such as sugars and sugar alcohols, and combinations thereof.

In embodiments of the invention, particularly preferred sugars include glucose, fructose, mannose, galactose, arabinose, xylose, ribose and combinations thereof.

In embodiments of the invention, particularly preferred sugar alcohols include sorbitol, mannitol, and combinations thereof.

The starches applied for the coating may in an embodiment e.g. be selected from a modified starch selected from the group comprising: an acid modified starch, an alkali modified starch, a bleached starch, an oxidised starch, an enzyme treated starch, an acetylated starch, an hydroxypropylated starch, a hydroxyethylated starch, and a carboxymethylated starch and a mixture thereof.

Referring to FIGS. 2A and 2B, application of coating material CM to a base paper BP to obtain a transfer paper TP is illustrated according to embodiments of the invention.

A first embodiment is illustrated in FIG. 2A. Here the coating material is dispensed from a coating material dispenser CMD e.g. via a suitably formed lip directly to the base paper BP, which moves around a roll RO in the direction indicated. This process may also be referred to as speed coating.

Another embodiment is illustrated in FIG. 2B. In FIG. 2B, the base paper BP is fed through two opposing rolls RO. The coating material CM is here applied to one of the rolls RO, which then by rotation transfers the coating material CM to the base paper BP.

It should be understood in the context of the embodiments of FIGS. 2A and 2B that single step coating application or multistep coating application may be applied.

Referring now to FIG. 3, a process of transferring ink from an inked transfer paper ITP to a textile TX is illustrated according to an embodiment of the invention.

As illustrated in FIG. 3, the inked transfer paper ITP is typically provided rolled up. Similarly, the blank textile TX is provided in roll form. The inked transfer paper ITP and the textile TX is then dispensed in a synchronous manner and joined at a cylinder roll RO and then concurrently moving towards the calender cylinder CC. The calender cylinder CC is heated to a temperature typically around 200 degrees Celsius. Upon contacting the calender cylinder CC, the inked transfer paper ITP is heated, and the ink is transferred from the inked transfer paper ITP to the textile TX to obtain an inked textile ITX.

Normally, the inked textile ITX is then dried before being rolled on rolls.

The used transfer paper TP is also rolled on rolls to facilitate transport e.g. to a paper mill for reprocessing, e.g. into a paper product.

In embodiments of the invention, the surface temperature of the calender cylinder CC is 180 to 230 degrees Celsius.

In an embodiment of the invention, an inked transfer paper ITP may be manufactured according to the following method:

a) designing a data representation of a predetermined pattern of colors;
b) feeding an ink jet printer with a transfer paper according to the invention or any of its embodiments;
c) providing said ink jet printer with information corresponding to said data representation of said pattern of colors obtained in step a);
d) allowing said ink jet printer to print a pattern of colors onto the transfer paper, said pattern of colors corresponding to the predetermined pattern of colors designed in step a).

In one embodiment of the present invention said one or more inks are traditionally and/or conventionally ink-jet inks, such as inks comprising water and one or more dyes, optionally with further additives such as glycerol.

Typically, inks of the colors black, cyan, magenta and yellow are used.

Examples of useful inkjet inks to be used in the manufacture of the inked transfer paper are: S4 Subli Black 774, Elvajet Ultra Black SE 101, S4 Subli Cyan 770 Light, S4 Subli Cyan 770, Elvajet Blue SE 100, S4 Subli Magenta 770 Light, S4 Subli Magenta 770, Elvajet Magenta SE 100, S4 Subli Yellow 781, Elvajet Yellow SE 100, all from the supplier Sensient, Switzerland.

Examples of usable industrial inkjet printers include: the Mimaki JV 33, Mimaki printer TS 500, and the Roland RS-640.

EXAMPLES

Example 1—Manufacturing of Base Paper

Transfer papers are manufactured by the following method.

First, the wood pulp is subjected to a careful processing comprising grinding (also referred to as beating) and alkaline treatment by sodium hydroxide. This processing is performed extensively, with total beating energy in the order of 300 kWh per ton of pulp to obtain pulp with a drainage resistance of about 70 SR (Schopper Riegler).

Then, the processed wood pulp is formed into a base paper BP01 with a thickness adjusted such that the final dried base paper has a weight of about 40 grams per square meter.

Further base papers were manufactured in accordance with table 1.

TABLE 1

Base papers with different beating resulting in corresponding drainage resistance.

| Base paper | BP01 | BP02 | BP03 | BP04 | BP05 |
|---|---|---|---|---|---|
| Drainage resistance | 70 | 60 | 50 | 80 | 90 |

Example 2—Application of Coating

A coating material is formed by mixing carboxymethylcellulose (CMC) with sorbitol. Ambergum™ 1221 was used as CMC, although other CMC products including such as Aqualon™ and Blanose™ from Ashland, was also used in similar tests. A 70% solution of sorbitol was used, 112090-Sorbitol 70% from DC Fine Chemicals. Sorbidex 200 from Toronto Research Chemicals has also been used in similar tests. The mixed coating material contained about 12% of CMC and about 20% of sorbitol. After mixing the coating material, the coating is then applied to the base paper BP01 of example 1 to obtain the final transfer paper TP01 (see table 2). Similarly, TP02-TP08 are made are made in accordance with table 2.

TABLE 2

Manufacturing of base papers BP01-BP05 is described in example 1.

| | Transfer paper | | | | | | | |
|---|---|---|---|---|---|---|---|---|
| | TP01 | TP02 | TP03 | TP04 | TP05 | TP06 | TP07 | TP08 |
| | Base paper | | | | | | | |
| | BP01 | BP02 | BP03 | BP04 | BP05 | BP01 | BP01 | BP01 |
| | Coating (content in wt. %) | | | | | | | |
| Sorbitol | 20 | 20 | 20 | 20 | 20 | 12 | 30 | 15 |
| CMC | 12 | 12 | 12 | 12 | 12 | 12 | 20 | — |
| Starch | — | — | — | — | — | — | — | 15 |

Transfer papers TP01-TP08 were all found to be substantially free of loose fibers and having a smooth, non-rough surface on the non-print side.

Example 3—Evaluation of Transfer Paper

The dimensional stability of the transfer paper TP01 obtained in example 2 is tested and compared to commercially available Kaspar lite65 transfer paper.

The test was performed on a Mimaki printer TS 500. The test was conducted at an ambient temperature 22 degrees Celsius and a room humidity of about 50%. The test was made with dark colors: (25 g/m2 water-based color of type Mimaki SB300). Paper tension in the printer was set to medium, the inside temperature of the machine was set to medium.

The dimensional stability was measured at a section 10 seconds after printing of that section.

For the transfer paper TP01, a dimensional stability (degree of expansion) of less than 0.12% was observed. For the commercially available Kaspar transfer paper, a degree of expansion of more than 1.0% was observed, i.e. more than 10 times more than TP01.

Furthermore, the Kaspar paper displayed a number of lines that commonly occur as a result of cockling.

No ink lines were observed in the transfer paper TP01, despite this paper with a weight of about 40 grams per square meter being significantly thinner that the Kaspar lite 65, which is labelled weight of 65 grams per square meter.

Example 4—Manufacturing of an Inked Transfer Paper

A transfer paper TP01 obtained in example 2 was used. This paper was loaded on a Mimaki printer TS 500. The ink jet printer was supplied with ink of the type S4.Subli.770 (black, cyan, magenta and yellow).

A print pattern comprising a spectrum of different colors was created on a personal computer. A representation of this pattern was sent to the inkjet printer via the corresponding software associated with the inkjet printer.

The printer was allowed to print the predetermined pattern on a length of the transfer paper TP01.

The applied ink was readily absorbed by the paper and the additive and the paper was sufficiently dry for packaging by rolling without any smearing of the ink occurring.

Example 5—Use of Inked Transfer Paper for Making an Inked Textile

The inked transfer paper from example 4 was loaded onto a transfer calander machine (Klievrik T130). The calander temperature was adjusted to 210° C. The speed of the paper was adjusted so that the paper had a contact time on the calander rolls of 25 seconds. The pressure on the calander rolls was 3 bar. A polyester fabric of width 160 cm and length 100 m was fed concurrently through the machine together with the paper.

The inked fabric was dried before being rewinded onto a roll. A quality control revealed that the obtained transferred ink pattern on the fabric was as high as on an inked fabric made by transferring the same ink pattern from a traditional transfer paper having a barrier coating of CMC.

Example 6—Kit Level

The transfer paper TP01 evaluated for its level of greaseproof by establishing the kit level. The TAPPI UM 557 was used to determine the kit level.

A kit level of 7 was obtained for TP01.

FIGURE REFERENCES

S1. Wood pulp providing step
S2. Processing step
S3. Paper forming step
S4. Coating step
WP. Wood pulp
PWP. Processed wood pulp
BP. Base paper
CM. Coating material
CL. Coating layer
TP. Transfer paper
CMD. Coating material dispenser
RO. Roll
ITP. Inked transfer paper
TX. Textile
ITX. Inked textile
CC. Calender cylinder
IN. Ink

The invention claimed is:

1. A transfer paper for heat transferring of ink to a textile, the transfer paper comprising
a base paper and
a coating,
wherein the transfer paper having grease proof characteristics at a kit level of at least 3, and
wherein the transfer paper having a dimensional stability of less than 1% over a period of 10 seconds;
wherein the coating comprises CMC and a saccharide, and
wherein the transfer paper has a Cobb(60) value of 25 to 40 g/m$^2$.

2. The transfer paper according to claim 1, wherein the coating comprises CMC.

3. The transfer paper according to claim 1, wherein the coating before application comprises CMC in an amount of 5-30% by weight of the coating.

4. The transfer paper according to claim 1, wherein the coating comprises CMC having a degree of substitution of at least 0.8.

5. The transfer paper according to claim 1, wherein the coating comprises a saccharide.

6. The transfer paper according to claim 1, wherein the coating before application comprises sorbitol in an amount of 5-50% by weight of the coating.

7. The transfer paper according to claim 1, wherein the transfer paper has a weight at most 80 grams per square meter.

8. The transfer paper according to claim 1, wherein the transfer paper has an air permeance measured according to SCAN-P 26:78 below 65 nm/(Pa·s).

9. The transfer paper according to claim 1, wherein the transfer paper is adapted to withstand temperatures of at least 200 degrees Celsius.

10. The transfer paper according to claim 1, wherein the base paper is made using an amount of pulp, wherein said pulp comprises beaten pulp in an amount of at least 35% by weight of said amount of pulp.

11. The transfer paper according to claim 1, wherein the transfer paper has a Cobb(60) value of 25 to 50 g/m$^2$.

12. The transfer paper according to claim 1, wherein the transfer paper comprises no more than 50 ppm of fluoride compounds.

13. A process for manufacturing a transfer paper, the process comprising the steps of:
providing wood pulp,
processing the wood pulp by beating and alkaline treatment to obtain a processed wood pulp,
forming the processed wood pulp into a base paper, and
applying a coating on the base paper to obtain a transfer paper having a Cobb(60) Value of 25 to 40 g/m$^2$,
wherein the coating comprises CMC and a saccharide.

14. An inked transfer paper for use for transferring ink to a textile, said inked transfer paper comprising a transfer paper according to claim 1, and at least one ink applied on a surface of said transfer paper.

15. The inked transfer paper according to claim 14 configured for transferring ink to a textile.

16. The transfer paper according to claim 1, wherein the transfer paper has grease proof characteristics at a kit level of 3 to 8.

17. The transfer paper according to claim 1, wherein the coating comprises sorbitol.

18. The transfer paper according to claim 1, wherein the transfer paper has a weight at most 40 grams per square meter.

* * * * *